United States Patent [19]

Widmyer

[11] 4,353,419

[45] Oct. 12, 1982

[54] METHOD FOR MANUFACTURING A WELL PRODUCTION AND SAND SCREEN ASSEMBLY

[75] Inventor: Richard H. Widmyer, Houston, Tex.

[73] Assignee: Texaco Inc., White Plains, N.Y.

[21] Appl. No.: 210,876

[22] Filed: Nov. 28, 1980

[51] Int. Cl.[3] ..... E21B 34/02; E21B 43/04; E21B 43/10

[52] U.S. Cl. ..... 166/379; 166/278; 166/380

[58] Field of Search ..... 166/278, 303, 276, 309, 166/379, 386, 387, 380

[56] References Cited

U.S. PATENT DOCUMENTS

| | | | |
|---|---|---|---|
| 1,530,221 | 3/1925 | Uren | 166/278 |
| 2,205,422 | 6/1940 | Layne | 166/278 |
| 2,349,062 | 5/1944 | Uren | 166/278 |
| 3,822,750 | 7/1974 | Ping | 166/309 |
| 3,951,457 | 4/1976 | Redford | 166/303 |
| 4,066,127 | 1/1978 | Harnsberger | 166/278 |
| 4,114,691 | 9/1978 | Payton | 166/276 |
| 4,124,074 | 11/1978 | Allen et al. | 166/278 |

*Primary Examiner*—Stephen J. Novosad
*Attorney, Agent, or Firm*—Carl G. Ries; Jack H. Park; Theron H. Nichols

[57] ABSTRACT

A method for forming and assembling a well production and sand screen assembly in a well having a screen therein forming an outer annulus and a wash pipe internally of the screen forming an inner annulus comprising further (a) mounting a high pressure fluid pump means and a valve means on each wash pipe, inner annulus, and outer annulus, and (b) connecting the valve means in fluid communication with the high pressure fluid pump means for controlling the ingress and egress of the high pressure fluids and removed formation material for forming a sand pack in the well and simultaneously for applying and maintaining a positive fluid pressure against the overburden during work in the well for preventing cave-ins and sloughing of the unconsolidated formation well walls until the sand pack is formed.

9 Claims, 7 Drawing Figures

P
21
11
V
12
19
15
22
V
P
ANNULUS 14
20
23
17
10
18
24
P
V
V
P
ANNULUS 16
13
29
28
25
27
26
24

METHOD FOR MANUFACTURING A WELL PRODUCTION AND SAND SCREEN ASSEMBLY

BACKGROUND OF THE INVENTION

This invention pertains to a method of assembling a well production and sand control system in unconsolidated, petroliferous formations. Basically, this invention solves the problem of a method for assembling a system for preventing cave-in and sloughing during drilling, enlargement, i.e., underreaming, gravel and screen placement and/or linear placement.

It is most desirable to utilize a large gravel or sand pack. The larger the sand pack, the more surface is available for sand pack drainage and for filtering for increased production of oil from the well. To form a large gravel pack, increased underreaming of the open hole below the casing for forming a larger cavity is required. Thus in unconsolidated sand formation the result is formation caving-in and sloughing thereof and during the subsequent steps of forming and placing the sand pack and screen and/or liner placement.

For solving this problem, the disclosed invention includes the novel feature or method steps for forming and assembling a system or apparatus for maintaining the sides of the unconsolidated formation under high positive pressure at all times from the time the high pressure fluid jetting starts forming the cavity in the well until a sand pack is completed for production of the well. This problem is prevalent, for example, from the formerly Texaco Slocum Field (bought in about 1902) in Anderson County, Texas to the Athabasca Tar Sands of Canada.

OBJECTS OF THE INVENTION

Accordingly, a primary object of this invention is to provide a novel method of assembling a well production and sand screen system for a well for preventing cave-in and sloughing of the unconsolidated formation well walls until a sand pack is formed.

A further object of this invention is to provide a new method for forming and assembling an apparatus for preventing cave-in and sloughing in a well while working in the well that is easy to operate, comprises simple steps, is economical to carry out and implement, and is of greater efficiency.

Other objects and various advantages of the disclosed method for forming and assembling a well production and sand control assembly for unconsolidated sand formation will be apparent from the following detailed description, together with the accompanying drawings, submitted for purposes of illustration only and not intended to define the scope of the invention, reference being made for that purpose to the subjoined claims.

BRIEF DESCRIPTION OF THE DRAWINGS

The drawings diagrammatically illustrate by way of example, not by way of limitation, one form of the system formed by the new method wherein like reference numerals designate corresponding parts in the several views in which.

Figure 1:
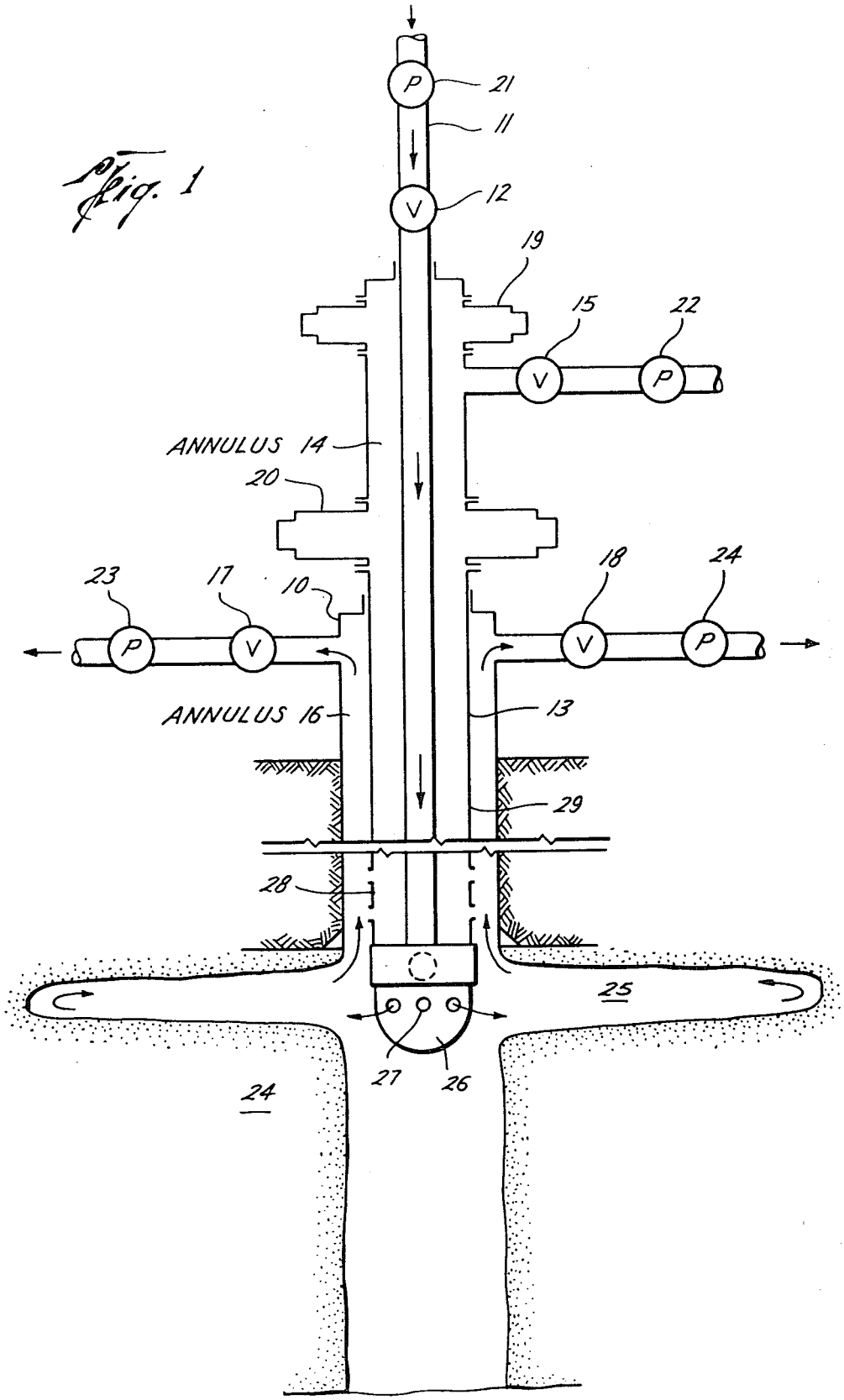
FIG. 1 is a schematic diagrammatic vertical sectional view of the apparatus for sand control of unconsolidated sand formation in which it is just starting to wash out an enlarged cavity for a large sand pack.

The cased well hole 10, FIG. 1, has a wash pipe 11 with valve 12 centrally supported in the well with structure (not totally shown). A screen supporting tubing 13 is mounted around the wash pipe and equally spaced therefrom with structure (not shown) forming an inner annulus 14. At least one valve 15 is shown on inner annulus 14. An outer annulus 16 is formed between the screen tubing 13 and the well casing 10. Outer annulus 16 has two valves, 17 and 18, for example, for controlling fluid therethrough. Likewise, blowout preventers, 19 and 20 are illustrated on the wash pipe 11 and inner annulus 14, respectively. A third blowout preventer (not shown) may be utilized on the outer annulus 16, if desired. Sources of pumping high pressure fluids in either direction are illustrated schematically as pump 21 on the wash pipe 11, pump 22 on inner annulus 14, and pumps 23 and 24 on outer annulus 16, particularly for maintaining the internal fluid pressure in the well cavity greater than the overburden in the well cavity walls.

First, with the nozzles positioned as shown in FIG. 1, high pressure cold water is ejected into the well immediately below the bottom of the casing into the top of the petroliferous sand formation. The transition is then made with predetermined time intervals to high pressure hot water and then to high pressure steam for ejection from the horizontal nozzles into the surrounding formation for beginning the forming of the large cavity. Then if a nozzle with only one or only a few jet orifices is utilized, the wash pipe and nozzle are rotated and lowered simultaneously slowly for washing out the large cavity 25 with steam ejection.

The invention disclosed herein, the scope of which being defined in the appended claims is not limited in its application to the details of construction and arrangement of parts shown and described, since the invention is capable of other embodiments and of being practiced or carried out in various other ways. Also, it is to be understood that the phraseology of terminology employed here is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

METHOD FOR MANUFACTURING A WELL PRODUCTION AND SAND SCREEN ASSEMBLY

A well production and sand screen assembly is manufactured or formed by the following new method comprising the following steps:

(1) supporting a screen (28, FIG. 1) on a tubing (29) for lowering into the well wherein the tubing forms an outer annulus (16, FIG. 2) between the tubing and the walls (10) of the well, (2) lowering a wash pipe (11) centrally of the screen and its supporting tubing for forming an inner annulus (14) between the washpipe and the screen, (3) connecting a high pressure fluid source means (21–24, FIG. 1) at the surface to each of the wash pipe, inner annulus, and other annulus, and (4) interconnecting valve means (12, 15, 17, and 18) to each of said wash pipe, inner annulus, and outer annulus, in fluid communication with the high pressure fluid source means for controlling the ingress and egress of the high pressure fluid for maintaining a constant high fluid pressure against the walls of the well greater than the overburden pressure therein during work therein for preventing cave-in and sloughing of the unconsolidated formation well walls until a sand pack (30, FIGS. 5–7) is formed between the screen and the walls.

The third and fourth method steps above may be expanded as follows:

(3) forming the high pressure fluid source means (21—24, FIG. 1) for providing high pressure cold water, high pressure hot water, and high pressure steam for injecting into the well, and (4) forming the valve means (12, 15, 17, and 18) in fluid communication with the high pressure fluid source for making the transition from injecting high pressure cold wash water into the well, to injecting high pressure hot wash water into the well, to injecting high pressure steam into the well within predetermined periods of time for forming a large cavity (25) in the formation for a large gravel pack (30, FIGS. 5–7) while continuously maintaining high fluid pressure against the cavity walls for prevention of thermal shock in the unconsolidated sand formation.

The fourth method step may be recited in greater detail (FIG. 3) as follows:

(4) forming the outer annulus valve means (17, 18) for being closed whenever the inner annulus valve means (15) is opened for maintaining high fluid pressure against the overburden for preventing cave-in and sloughing of the unconsolidated formation well walls.

The fourth method step may be expanded further as follows:

(4) forming the outer annulus valve means (17, 18) for being opened whenever the wash pipe means (11, 12) is closed maintaining high fluid pressure against the overburden for preventing cave-in and sloughing of the unconsolidated formation well walls.

The fourth method step may comprise the following:

(4) forming the outer annulus valve means (17, 18) for being opened whenever the wash pipe valve means (11, 12) is closed for commingling and injecting sand with the injection fluid down the outer annulus (16) for filling the cavity with a sand pack (30, FIG. 5) while maintaining high fluid pressure against the overburden for preventing cave-in and sloughing of the unconsolidated formation well walls.

The fourth method step also comprises the following step:

(4) lowering into the well and connecting thereto a production tube means (29) and a packer means (31, FIG. 7) for providing full production of fluids from the well in the unconsolidated formation after the sand pack (30) is in.

A method of manufacturing by assembling a well production and sand pack forming system having a screen (28, FIG. 1) positioned internally of the well with a wash pipe (11) positioned internally on the screen with a jet nozzle (27) at the bottom thereof forming inner (14, FIG. 2) and outer (16) annuli in the well comprising further, (1) connecting high pressure fluid pump means (21, 22, 23, and 24) to the wash pipe and each of the two annuli, and (2) connecting valve means (12, 15, 17, and 18) to each of the wash pipe, inner annulus, and outer annulus in fluid communication with the high pressure fluid pump means for controlling the ingress and egress of fluids and removed formation material for forming the sand pack in the well and simultaneously for applying and maintaining a positive fluid pressure against the overburden during work in the well for preventing cave-in and sloughing of the unconsolidated formation well walls until the sand pack is formed.

A further method of manufacturing by assembling a well production and a sand pack forming system in a well having a screen positioned internally of the well with a wash pipe positioned internally of the screen for forming inner and outer annuli in the well comprises further, (1) mounting high pressure fluid pump means (21, 22, 23 and 24) and valve means (12, 15, 17, and 18) on each of the wash pipe (11), inner annulus (14) and outer annulus (16), and (2) connecting the valve means in fluid communication with the high pressure fluid pump means for controlling the ingress and egress of the high pressure fluid for applying and maintaining a positive fluid pressure against the overburden and simultaneously forming the sand pack in the well for preventing cave-in and sloughing of the unconsolidated formation well walls until the sand pack is formed.

THE PREFERRED EMBODIMENT FOR PRACTICING THE INVENTION

The preferred system for placing a well in production that is drilled in an unconsolidated formation where cave-in and sloughing is a common and usual occurrence formed by the above methods comprises first a mechanism or system for forming a larger cavity than usual in the well for holding a larger than the conventional sand pack for providing a larger pack drainage area and more sand filtering surface. Normally, this would require considerable underreaming with large unsupported walls resulting in cave-ins and sloughing.

FIG. 1 is a schematic diagrammatic vertical sectional view of the apparatus for sand control of an unconsolidated sand formation, and particularly a petroliferous formation. Further, this apparatus may clean out an existing well, whether it is washing out a well that has sanded up, whether it is enlarging a previously drilled well, or whether it is drilling a large cavity in a new well through an unconsolidated petroliferous sand formation mentioned above.

The cased well hole 10, FIG. 1, has a wash pipe 11 with valve 12 centrally supported in the well with structure (not totally shown). A screen supporting tubing 13 is mounted around the wash pipe and equally spaced therefrom with structure (not shown) forming an inner annulus 14. At least one valve 15 is shown on inner annulus 14. An outer annulus 16 is formed between the screen tubing 13 and the well casing 10. Outer annulus 16 has two valves, 17 and 18, for example, for controlling fluid therethrough. Likewise, blowout preventers, 19 and 20 are illustrated on the wash pipe 11 and inner annulus 14, respectively. A third blowout preventer (not shown) may be utilized on the outer annulus 16, if desired. Sources of pumping high pressure fluids in either direction are illustrated schematically as pump 21 on the wash pipe 11, pump 22 on inner annulus 14, and pumps 23 and 24 on outer annulus 16, particularly for maintaining the internal fluid pressure in the well cavity greater than the overburden in the well cavity walls.

First, with the nozzles positioned as shown in FIG. 1, high pressure cold water is ejected into the well immediately below the bottom of the casing into the top of the petroliferous sand formation. The transition is then made with predetermined time intervals to high pressure hot water and then to high pressure steam for ejection from the horizontal nozzles into the surrounding formation for beginning the forming of the large cavity. Then if a nozzle with only one or only a few jet orifices is utilized, the wash pipe and nozzle are rotated and lowered simultaneously slowly for washing out the large cavity 25 with steam ejection.

FIG. 1 shows a typical 16 foot (about 5 meters) diameter cased well hole for example, washed out initially at the very beginning. Then as the wash pipe 11 is lowered slowly for only the depth of the petroliferous strata 24 of the unconsolidated formation to the position of FIG. 2, a large cylindrical shaped cavity 25 is formed for a typical depth of 24 feet (about 7 meters) for example. A nozzle housing 26 having a plurality of orifices 27, FIGS. 1–2, preferably, is attached to the lower end of a screen 28 which in turn is attached to the lower end 29 of a support tube 13 on the lower end of the drilling string (not shown).

While a two orifice nozzle requires rotation as it is lowered in the well for washing out a cavity as illustrated in assignee's U.S. Pat. No. 4,066,127, issued Jan. 3, 1978, with several orifices 27, FIG. 1, around the periphery of the nozzle 26, where lowering of the nozzle slowly is sufficient to wash out the cavity 25, if so desired.

The formation sand returns are carefully monitored for estimating the size of the well cavity as it is formed by washing out the unconsolidated formation.

Figure 2:
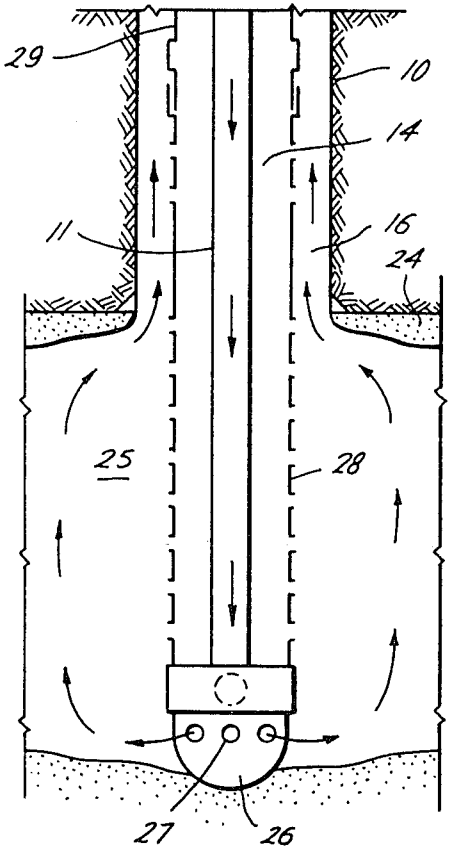
FIG. 2 is a schematic vertical sectional view of the well and apparatus of FIG. 1 after having completed the cavity therein wherein the spent fluid and removed formation material or "pulp" is being ejected from the outer annulus.

FIG. 2 illustrates the well cavity after it has been washed out to the final or total depth (TD). The high pressure fluid pump 21, as a water pump for example, maintains high fluid pressure in the wash pipe 11, and with valve 12 open, maintains high fluid pressure in the well and against the overburden or pressure in the walls of the cavity 25 as they tend to cave-in and slough in. Likewise, high pressure fluid pumps 22, 23, and 24 maintain high pressure in the cavity when their respective valves 15, 17, and 18 are opened as required.

Thus with opening of high pressure valve 12 in the wash pipe, the wash fluid circulation, as water, for example, is circulated down wash pipe 11, FIGS. 1–2, out the nozzle orifice 27, through the cavity 25 picking up any loose material, and ejecting it up the outer annulus 16 through valves 17 and 18 for maintaining a high positive fluid pressure against the walls of the cavity for preventing cave-in and sloughing of the cavity walls, FIG. 2.

REVERSAL OF FLOW STEPS

Figure 3:
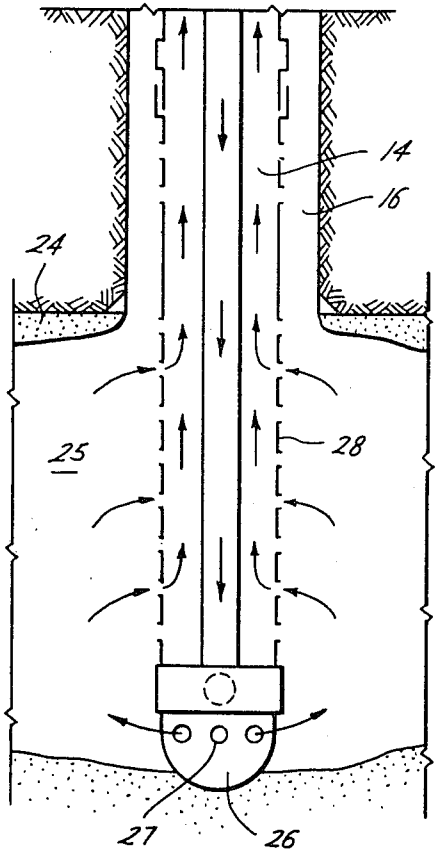
FIG. 3 is a schematic vertical sectional view of the well of FIG. 2 with the fluid flow of spent fluid from the outer annulus having being changed to exit from the inner annulus after the formation material has been removed.

FIG. 3 shows the first step in reversing the fluid flow of FIG. 2 for eventually depositing the gravel pack in the large cavity. The inner annulus valve 15, FIG. 1, is opened while simultaneously outer annulus valves 17 and 18 are closed in making the change over of ejecting the cavity fluids up and out of the inner annulus 14 instead of the outer annulus 16. During this change over of ejected fluids, the valves 15 and 17, 18 are operated gradually and simultaneously in order to maintain the high positive fluid pressure on the walls of the cavity, to prevent caving-in and sloughing of the cavity walls, FIG. 4.

Figure 4:
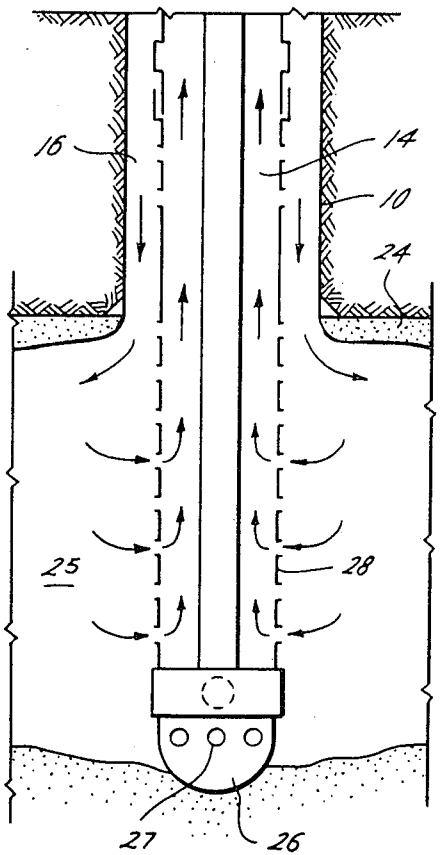
FIG. 4 is a schematic vertical sectional view of the well of FIG. 3 with the fluid flow illustrated as having been changed by ceasing flow in the wash pipe and simultaneously beginning flow down the outer annulus.

FIG. 4 illustrates the resultant fluid flow after the outer annulus valves 17 and 18, FIG. 1, are opened and gradually and simultaneously, or with a slight delay, the wash pipe valve 12 is closed for changing the inlet fluid flow from the wash pipe 11 to the outer annulus 16. During this change over of injected fluids, valves 12 and 17, 18 are operated simultaneously in order to maintain the high positive fluid pressure on the walls of the cavity to prevent cave-in and sloughing of the cavity walls, FIG. 5. Now total reversal of fluid has been accomplished while maintaining the high positive pressure on the cavity walls.

Figure 5:
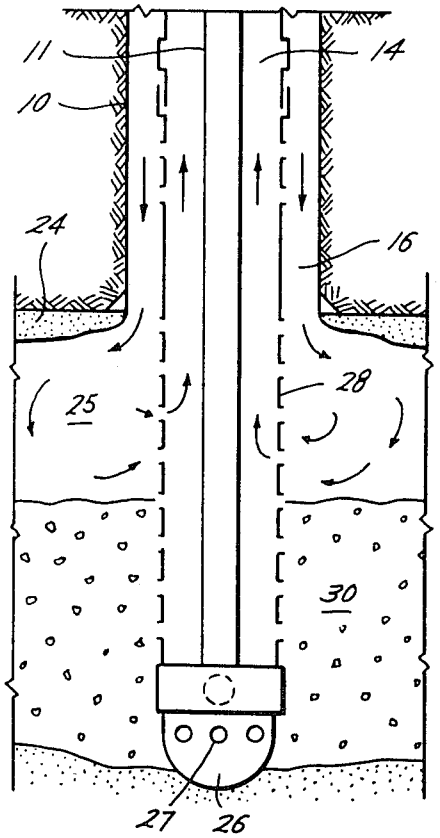
FIG. 5 is a schematic vertical sectional view of the well of FIG. 4 with sand being commingled with the incoming fluid flow for forming a sand pack in the well cavity.

Then, one of the valves 17 or 18, FIG. 5, is operated to commingle sand with the injection fluid as it is ejected down the wash pipe 11 to the cavity 25 for forming a sand pack 30 while maintaining high fluid pressure against the overburden for preventing cave-in and sloughing of the unconsolidated formation well walls. The sand fills the cavity from bottom up, and is filtered out on the screen as the injection fluid returns up the inner annulus 14 after passing through the screen 28. As the sand pack 30 is formed completely around the screen, the increased fluid pressure in outer annulus 16 will so indicate the filling of the cavity and thus the completion of the sand pack.

Figure 6:
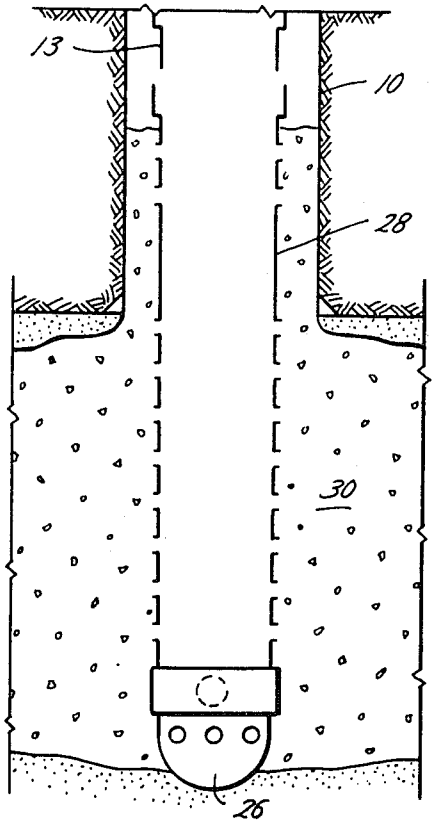
FIG. 6 is a schematic vertical sectional view of the well of FIG. 5 after completion of the gravel pack has been detected and the wash pipe has been removed and the screen support tube is being removed.

As illustrated in FIGS. 1 and 6, the large blowout preventer 20 is then removed and then the wash pipe 11 and screen supporting tubing 13 are removed.

Figure 7:
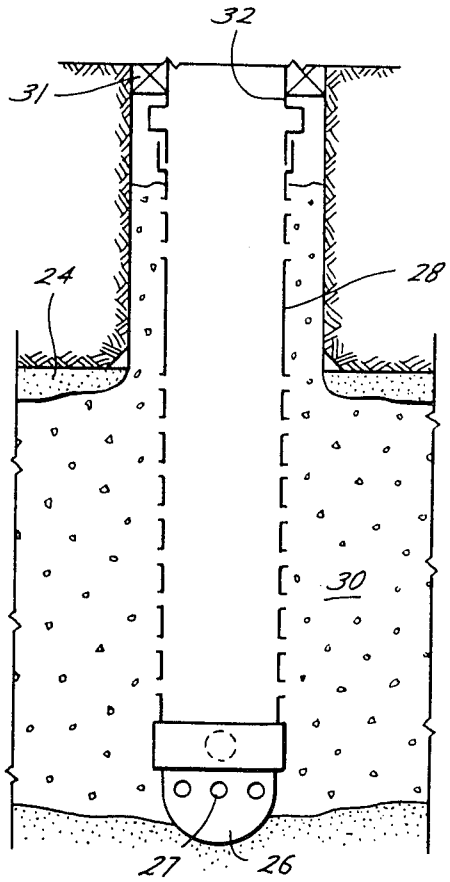
FIG. 7 is a schematic vertical sectional view of the well of FIG. 6 with the production tube not shown and with a packer installed for placing the well in production status.

FIG. 7 illustrates that after the circulation has stopped, then the small blowout preventer 19 is removed, a packer 31 is lowered in position, and a production tube 32 is connected to the top of the screen and packed to place the well in production status for flowing fluids, as crude oil from the petroliferous unconsolidated sand formation flows through the sand pack, through the screen, and up the production tube to the surface, a pump being added if necessary.

Accordingly, it will be seen that the disclosed method for forming and assembling a well production and sand screen system to prevent cave-in and sloughing in unconsolidated formations will operate in a manner which meets each of the objects set forth hereinbefore.

While only one mechanism formed and assembled by the new method has been disclosed, it will be evident that various other modifications are possible in the method.

I claim:

1. A method for manufacturing a screen assembly in a well in unconsolidated sand formation while preventing cave-in and sloughing in the well comprising, (a) supporting a screen on a tubing for lowering into the well wherein the tubing forms an outer annulus between the tubing and the walls of the well, (b) lowering a wash pipe centrally of the screen and its supporting tubing for forming an inner annulus between the wash pipe and the screen, (c) connecting a high pressure fluid source means at the surface to each of the wash pipe, inner annulus, and outer annulus, and (d) interconnecting valve means to each of said wash pipe, inner annulus, and outer annulus in fluid communication with the high pressure fluid source means for controlling the ingress and egress of the high pressure fluid for maintaining a constant high fluid pressure against the walls of the well greater than the overburden pressure therein during work therein for preventing the cave-in and sloughing of the unconsolidated formation well walls until a sand pack is formed between the screen and the walls.

2. A method as recited in claim 1 wherein method step two includes further, (a) interconnecting the lower end of the wash pipe and the lower end of the screen with a nozzle means for increasing the rigidity of the lower end of the inner annulus.

3. A method as recited in claim 1 prior to the third step comprising, (a) forming the high pressure fluid source means for providing high pressure cold water, high pressure hot water, and high pressure steam for injecting into the well, and (b) forming the valve means in fluid communication with the high pressure fluid source for making the transition from injecting high pressure cold wash water into the well, to injecting high pressure hot wash water into the well, to injecting high pressure steam into the well within predetermined periods of time for forming a large cavity in the formation for a large gravel pack while continuously maintaining high fluid pressure against the cavity walls for prevention of thermal shock in the unconsolidated sand formation.

4. A method as recited in claim 1 wherein the fourth method step comprises further, (a) forming the outer annulus valve means for being closed whenever the inner annulus valve means is opened for maintaining high fluid pressure against the overburden for preventing the cave-in and sloughing of the unconsolidated formation well walls.

5. A method as recited in claim 1 or 4 wherein the fourth method step comprises further, (a) forming the outer annulus valve means for being opened whenever the wash pipe means is closed for maintaining high fluid pressure against the overburden for preventing the cave-in and sloughing of the unconsolidated formation well walls.

6. A method as recited in claim 1 wherein the fourth method step comprises further, (a) forming the outer annulus valve means for being opened whenever the wash pipe valve means is closed for commingling and injecting sand with the injection fluid down the outer annulus for filling the cavity with a sand pack while maintaining high fluid pressure against the overburden for preventing the cave-in and sloughing of the unconsolidated formation well walls.

7. A method for manufacturing as recited in claims 1 or 6 werein the fourth method step comprises further, (a) lowering in the well and connecting thereto a production tube means and a packer means for providing full production of fluids from the well in the unconsolidated formation after the sand pack is in.

8. A method of manufacturing by assembling a well production and sand pack forming system in a well in unconsolidated sand formation while preventing cave-in and sloughing in the well having a screen positioned internally of the well with a wash pipe positioned internally on the screen with a jet nozzle at the bottom thereof forming inner and outer annuli in the well comprising further, (a) connecting high pressure fluid pump means to the wash pipe and each of the two annuli, and (b) connecting valve means to each of the wash pipe, inner annulus, and outer annulus in fluid communication with the high pressure fluid pump means for controlling the ingress and egress of fluids and removed formation material for forming the sand pack in the well and simultaneously for applying and maintaining a positive fluid pressure against the overburden during work in the well for preventing the cave-ins and sloughing of the unconsolidated formation well walls until the sand pack is formed.

9. A method of manufacturing by assembling a well production and a sand pack forming system in a well in unconsolidated sand formation while preventing cave-in and sloughing in the well having a screen positioned internally of the well with a wash pipe positioned internally of the screen for forming inner and outer annuli in the well comprising further, (a) mounting high pressure fluid pump means and valve means on each of the inner annulus, outer annulus, and wash pipe, and (b) connecting the valve means in fluid communication with the high pressure fluid pump means for controlling the ingress and egress of the high pressure fluid for applying and maintaining a positive fluid pressure against the overburden and simultaneously forming the sand pack in the well for preventing the cave-in and sloughing of the unconsolidated formation well walls until the sand pack is formed.

* * * * *